United States Patent [19]

Sako et al.

[11] Patent Number: 4,670,701

[45] Date of Patent: Jun. 2, 1987

[54] RECHARGEABLE CORDLESS VACUUM CLEANER APPARATUS

[75] Inventors: Yukinobu Sako, Osaka; Tatsuya Shimoyama; Yoshinori Matsunaga, both of Kyoto, all of Japan

[73] Assignee: Matsushita Electric Industrial Co., Ltd., Osaka, Japan

[21] Appl. No.: 799,073

[22] Filed: Nov. 18, 1985

[30] Foreign Application Priority Data

| | | | |
|---|---|---|---|
| Nov. 19, 1984 | [JP] | Japan | 59-243656 |
| Nov. 19, 1984 | [JP] | Japan | 59-243657 |
| Nov. 19, 1984 | [JP] | Japan | 59-243658 |

[51] Int. Cl.[4] ..... H02J 7/00; A47L 9/00

[52] U.S. Cl. ..... 320/2; 15/DIG. 1

[58] Field of Search ..... 320/2; 15/DIG. 1

[56] References Cited

U.S. PATENT DOCUMENTS

| | | | |
|---|---|---|---|
| 3,348,116 | 10/1967 | Freeman et al. | 320/2 |
| 3,840,795 | 10/1974 | Roszyk et al. | 320/2 |
| 4,225,814 | 9/1980 | Gantz et al. | 320/2 |
| 4,573,234 | 3/1986 | Kochte et al. | 320/2 X |
| 4,591,777 | 5/1986 | McCarty et al. | 320/2 |

FOREIGN PATENT DOCUMENTS

| | | | |
|---|---|---|---|
| 3228491 | 2/1984 | Fed. Rep. of Germany | 320/2 |

*Primary Examiner*—W. B. Perkey

*Attorney, Agent, or Firm*—Pollock, VandeSande & Priddy

[57] ABSTRACT

A rechargeable cordless vacuum cleaner apparatus includes a hand-held cordless vacuum cleaner containing rechargeable batteries, a motor, a fan driven by the motor and a dust-collection filter, and a charging unit containing a power transformer and rectifier diode, with the charging unit being formed with a pocket to removably retain the vacuum cleaner with charging terminals of the charging unit engaged in an electrical receptacle of the vacuum cleaner. Ribs or grooves are formed on an end of the vacuum cleaner which is inserted in the charging unit pocket, and these slidably engage with corresponding grooves or ribs formed on the charging unit, for accurate engagement. A microswitch on the vacuum cleaner acts to disconnect the batteries from a motor drive circuit and connect them to a charging circuit when the vacuum cleaner is inserted in the charging unit.

8 Claims, 9 Drawing Figures

RECHARGEABLE CORDLESS VACUUM CLEANER APPARATUS

BACKGROUND OF THE INVENTION

The present invention relates to a rechargeable cordless vacuum cleaner apparatus comprising a hand-held vacuum cleaner having rechargeable batteries and a charging unit for charging the batteries of the cleaning unit in an upright position. The vacuum cleaner includes a motor which is driven by the rechargeable batteries, a fan which is coupled to the motor, a nozzle for suction intake of air into the fan, and a dust filter for collecting dust which is drawn through the nozzle by the fan suction. The charging unit contains a charging circuit including a transformer and rectifier, and terminals which engage electrically with corresponding terminals of the cleaning unit when the latter is placed on the storing and charging unit.

An example of a prior art rechargeable cordless vacuum cleaner apparatus of this type is described in U.S. Pat. No. 4,225,814. In that invention, a pair of charging terminals are disposed substantially at the center of a base, which functions as a charging unit as described above. The vacuum cleaner is of elongated shape, and the base is shaped such that opposite ends thereof engage with opposite ends of the vacuum cleaner housing when vacuum cleaner is placed thereon, with the charging terminals of the base becoming electrically connected within an electrical receptacle mounted on the vacuum cleaner. The base is connected by an electric power cord to a standard AC power outlet to perform automatic charging of the vacuum cleaner when mounted on the base. Such an arrangement has the disadvantage that there is a substantial distance between the charging terminals on the base and the ends of the base which engage with the corresponding ends of the vacuum cleaner, and similarly there is an appreciable distance between the electrical receptacle of the vacuum cleaner and the end portions of the vacuum cleaner which engage with the base. As a result of this configuration, it is difficult for the user to rapidly position the vacuum cleaner upon the base with the charging terminals correctly engaged within the electrical receptacle of the vacuum cleaner.

SUMMARY OF THE INVENTION

It is an object of the present invention to overcome problems which arise with prior art types of rechargeable cordless vacuum cleaner apparatus such as that described above, and to provide a rechargeable cordless vacuum cleaner apparatus made up of a cordless vacuum cleaner and a charging unit for storing and recharging the batteries of the vacuum cleaner, whereby the vacuum cleaner can be easily mounted on the charging unit. In order to achieve the above objectives, the exterior of a charging unit of a rechargeable cordless vacuum cleaner apparatus according to the present invention is formed with a pocket, i.e. a concave portion, which is shaped such as to removably retain one end of the vacuum cleaner of that rechargeable cordless vacuum cleaner. An electrical receptacle is mounted on the latter end of the vacuum cleaner to receive electrical power for recharging the batteries of the vacuum cleaner, and corresponding charging terminals are mounted on the exterior of the charging unit. Ribs or grooves are formed in the pocket portion of the charging unit, adjacent to the charging terminals, and corresponding grooves or ribs are formed on the aforementioned end of the vacuum cleaner, with these ribs and grooves being positioned and shaped such as to mutually slidably engage when the vacuum cleaner is inserted into the charging unit, and ensure that the charging terminals of the charging unit are correctly and securely engaged within the electrical receptacle of the vacuum cleaner when such insertion has been fully accomplished, to thereby electrically connect the charging terminals to connecting leads which lead from the electrical receptacle of the vacuum cleaner to a charging circuit. In this way, automatic recharging of the batteries of the vacuum cleaner is reliably initiated each time the vacuum cleaner is inserted into the charging unit.

According to one aspect of the invention, the aforementioned grooves are formed on the vacuum cleaner, and the ribs are formed on the charging unit, while microswitch means is disposed within one of the grooves of the vacuum cleaner. The microswitch means is adapted such as to connect the rechargeable batteries of the vacuum cleaner to a discharge circuit, i.e. to the motor which drives the fan of the vacuum cleaner, when the vacuum cleaner is removed from the charging unit, and is actuated by sliding engagement of one of the ribs of the charging unit within the latter groove of the vacuum cleaner such as to disconnect the rechargeable batteries from the discharge circuit and connect them to a charging circuit, i.e. to receive a charging current which is derived from power supplied from the charging terminals of the charging unit. In this way, even if the connecting leads in the electrical receptacle of the vacuum cleaner should be accidentally short-circuited when the vacuum cleaner is outside the charging unit, no discharging of the batteries will result, so that damage to the batteries due to excessively rapid discharge will not occur.

In another aspect, the vacuum cleaner of the invention is of slightly elongated shape, with an electrical receptacle being mounted at one end as described above, and the apparatus is preferably arranged such that the vacuum cleaner is retained in the charging unit in a substantially vertical orientation. As a result, a large proportion of the total weight of the vacuum cleaner acts to forcibly maintain the charging terminals of the charging unit correctly engaged with the electrical receptacle of a vacuum cleaner.

In yet another aspect, a vacuum cleaner of a rechargeable cordless vacuum cleaner apparatus according to the present invention is provided with at least one removable nozzle, adapted to be retained within a suction aperture at the opposite end of the vacuum cleaner to an electrical receptacle utilized for battery charging, while a charging unit of the rechargeable cordless vacuum cleaner apparatus has a nozzle storage mount provided externally thereon which is positioned immediately above a lead-out aperture from which an electric power cord emerges from the charging unit. Due to this position of the nozzle storage amount, the danger of accidental damage to the electric power cord at the lead-out aperture position is greatly reduced. The apparatus preferably includes a pair of such nozzles, i.e. a long and a short nozzle. In this case, a stopper member for determining the depth of insertion of the long nozzle into the storage mount is positioned to enable a greater depth of insertion than a stopper member for the short nozzle, to thereby ensure more stable retention of the respective nozzles within the nozzle storage mount.

DESCRIPTION OF THE PREFERRED EMBODIMENTS

Figure 1:
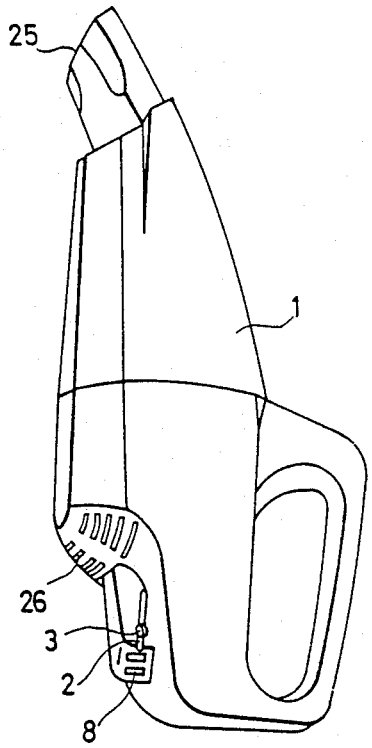
FIG. 1 and FIG. 2 are oblique views of an embodiment of a rechargeable cordless vacuum cleaner and a charging unit, respectively, for a rechargeable cordless vacuum cleaner apparatus according to the present invention.

Referring first to FIG. 1, an oblique view of an embodiment of a cordless vacuum cleaner for a rechargeable cordless vacuum cleaner apparatus according to the present invention is shown. Such a vacuum cleaner is designed to be sufficiently compact in size and light in weight to permit hand-held operation. The body of the vacuum cleaner is denoted by reference numeral 1, while numeral 2 denotes a pair of grooves which is formed on opposite sides of one end of the vacuum cleaner 1. As described in the following, the latter end of the vacuum cleaner is maintained in a downward position when the vacuum cleaner is stored, and hence will be referred to as the lower end, for ease of description. A microswitch 3 is mounted within one of grooves 2. A charging unit 4 for storing and recharging vacuum cleaner 1 is shown in oblique external view in FIG. 2, in which reference numeral 5 denotes a pocket, i.e. recessed portion formed in the charging unit 4, which is shaped in accordance with the shape of the lower end of vacuum cleaner 1 such as to removably retain vacuum cleaner 1 therein. As shown, a set of faces which constitute a main portion of pocket 5, designated as **5*a*, 5*b* and 5*c*, slope in a downward direction towards the front of charging unit 4. Reference numeral 6 denotes a pair of ribs which is formed in correspondence with the pair of grooves 2 of vacuum cleaner 1, such as to permit mutual sliding engagement therebetween as described hereinafter. Reference numeral 7 denotes a pair of charging terminals which protrude vertically upward within pocket 5 of charging unit 4 and are positioned such as to engage within a corresponding electrical receptacle 8 which is provided in the lower end of vacuum cleaner 1**.

Figure 3:
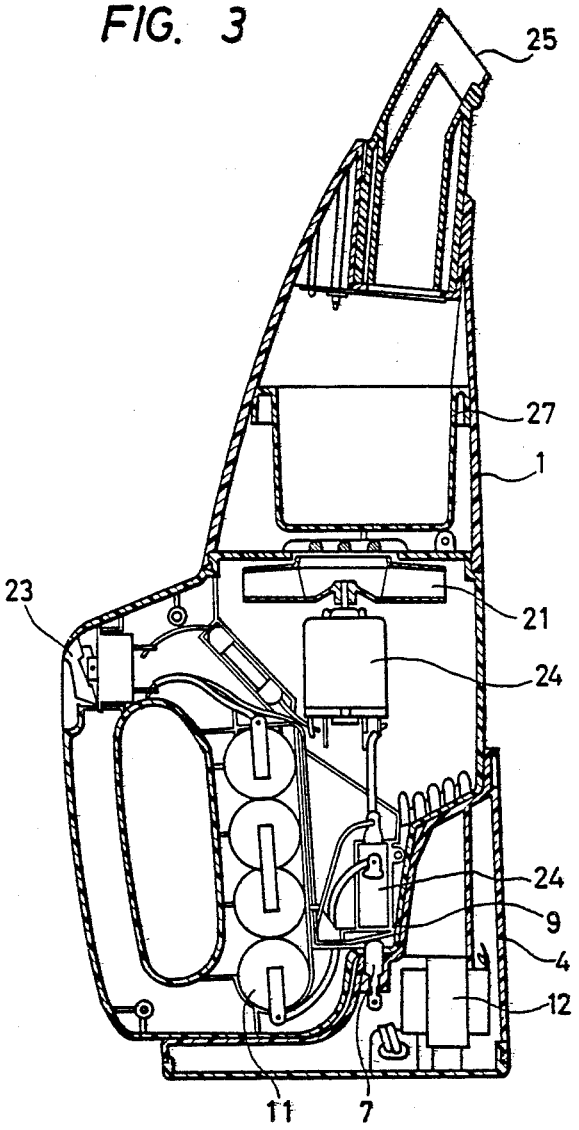
FIG. 3 is a central cross-sectional view showing the vacuum cleaner of FIG. 1 inserted into the charging unit of FIG. 2 for storage and charging.

The engaging relationship between vacuum cleaner 1 and charging unit 4 when vacuum cleaner 1 is inserted into charging unit 4 charging and storage is illustrated by the cross-sectional view of FIG. 3. As shown, connecting leads 9 extend into the interior of vacuum cleaner 1 from electrical receptacle 8, so that with vacuum cleaner 1 inserted in pocket 5 of charging unit 4, connecting leads 9 become electrically connected to charging terminals 7. The sliding engagement between the ribs 6 and grooves 2 of charging unit 4 and vacuum cleaner 1, referred to above, ensures that charging terminals 7 are correctly engaged in electrical receptacle 8 and are held securely in this engaging relationship, so that electrical contact is maintained between charging terminals 7 and connecting leads 9, while in addition the vacuum cleaner 1 is securely retained in pocket 5 of charging unit 4.

Figure 2:
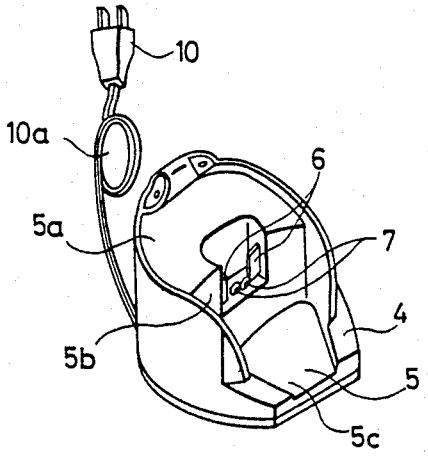

An electric power plug 10 shown in FIG. 2 can be inserted into an AC mains supply to supply power to charging unit 4 for recharging a set of rechargeable batteries 11 which are mounted internally in vacuum cleaner 1. Referring again to FIG. 3, charging unit 4 further includes a power transformer 12 connected via an electric power cord **10*a* to power plug 10, and a rectifier diode 13. The transformer 12 and rectifier diode 13 are provided within a charging circuit described hereinafter which produces a charging voltage for recharging batteries 11**.

Figure 4:
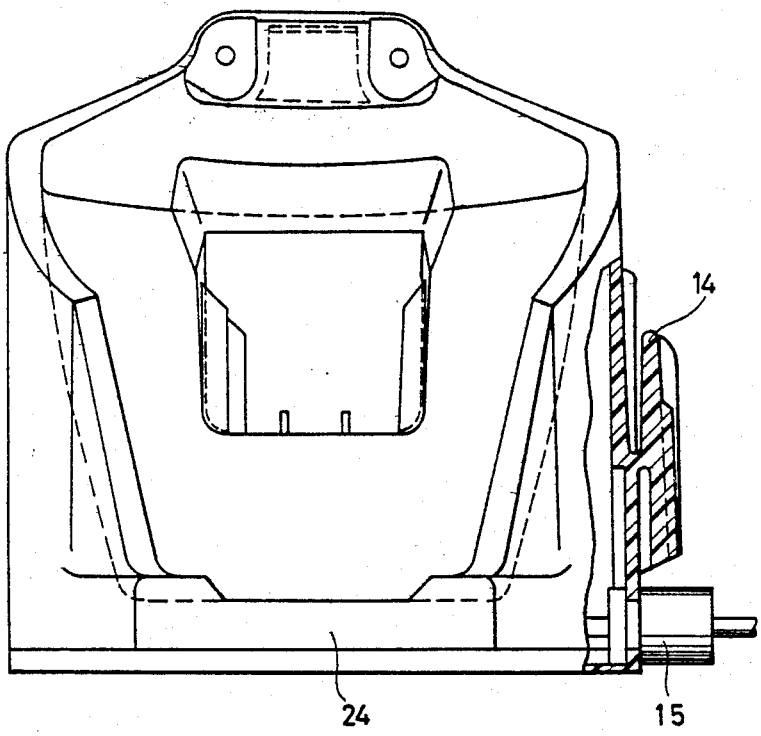
FIG. 4 is a front view of the charging unit of FIG. 1.
Figure 5:
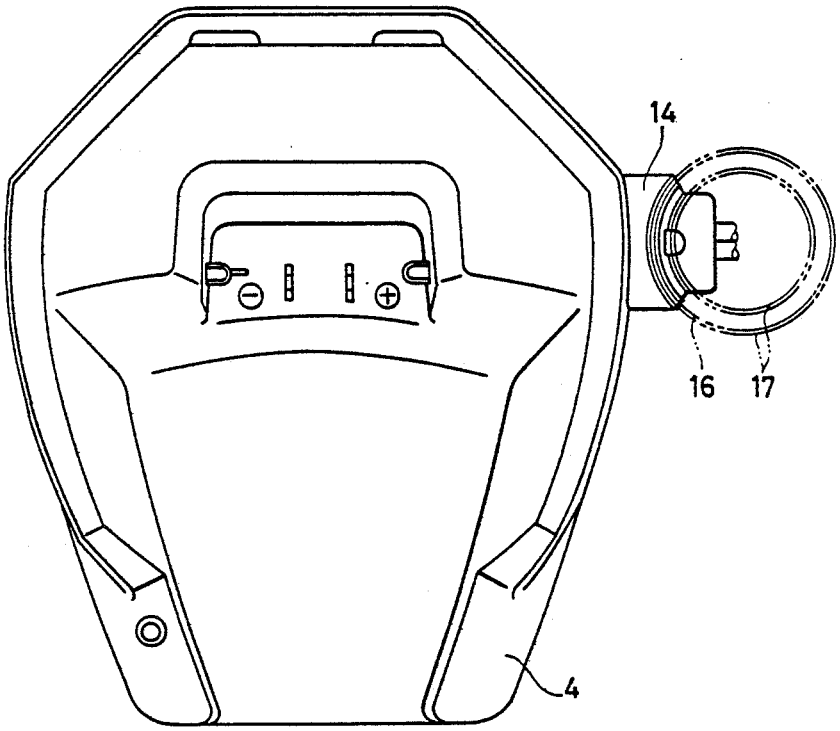
FIG. 5 is a plan view of the charging unit of FIG. 1.
Figure 6:
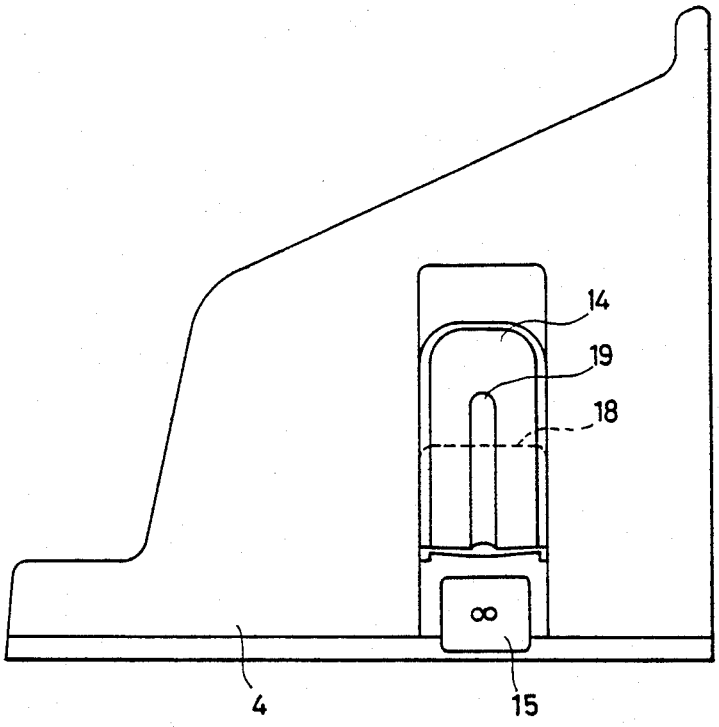
FIG. 6 is a side view of the charging unit of FIG. 1.
Figure 7:
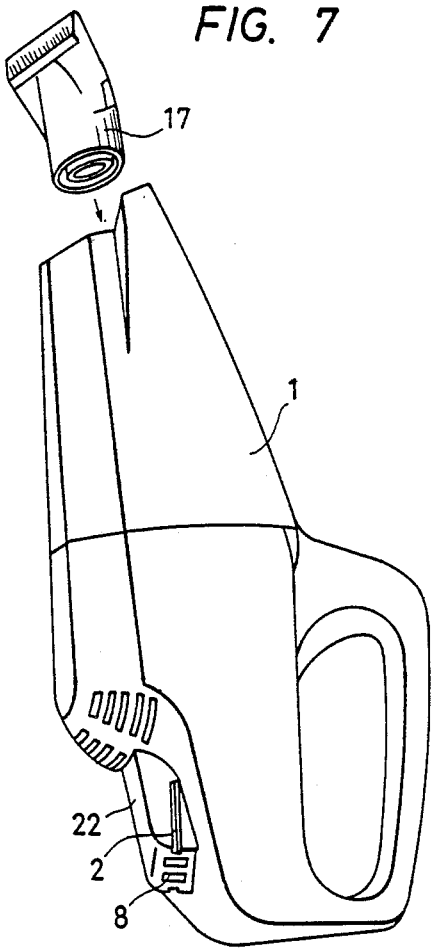
FIG. 7 is another oblique view of the vacuum cleaner of FIG. 1.
Figure 8:
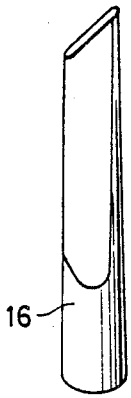
FIG. 8 is an oblique view of a long nozzle.

FIGS. 4, 5 and 6 are front, plan and side views respectively of the exterior of charging unit 4, in which reference numeral 14 denotes a nozzle storage mount for removably retaining each of a pair of interchangeable nozzles, described hereinafter. The power cord **10*a* is retractable into the interior of charging unit 4 through an aperture formed in an outlet section 15 of charging unit 4, which is positioned immediately below the nozzle storage mount 14. The nozzle storage mount is shaped to removably retain a short nozzle 17, shown in FIG. 7, and a long nozzle 16 which is of elongated tubular shape and is shown in FIG. 8. The nozzle storage mount 14 includes a long nozzle stopper 18 and a short nozzle stopper 19, with the long nozzle stopper 18 being positioned at a greater depth within nozzle storage mount 14 than the short nozzle stopper 19. Due to this configuration, the long nozzle 16 can be inserted into the nozzle storage mount 14 to a greater depth than the short nozzle 17, to thereby ensure that the long nozzle 16 is removably retained in highly stable manner. Also, due to the fact that the nozzle storage mount 14 is positioned directly above the outlet section 15 for retractable power cord 10*a*, the danger of accidental damage to power cord 10*a* is greatly reduced, i.e. damage resulting from a person treading upon the power cord 10*a* at the position where the cord emerges from charging unit 4**.

As shown in FIG. 3, a set of rechargeable batteries 11 is disposed in the interior of vacuum cleaner 1, together with an electric motor 20, whose drive shaft is coupled to a fan 21. A press-type normally open switch 23 is connected between motor 20 and rechargeable batteries 11 such that, with vacuum cleaner 1 removed from charging unit 4, depression of switch 23 results in rechargeable batteries 11 being connected to supply power to motor 20, whereby fan 21 is rotated to produce an inward flow of air through a suction aperture 25 formed in the opposite end of vacuum cleaner 1 to electrical receptacle 8. The suction aperture 25 is shaped such as to removably retain the long nozzle 16 or the short nozzle 17 therein, and dust which is drawn along through the nozzle and aperture 25 together with the aforementioned air flow is collected by a dust collection filter 27. Air which then passes out through filter 27 is output through an air outlet aperture 26, which is positioned at the opposite end of vacuum cleaner 1 to the suction aperture 25. This directly opposing relationship between the suction aperture 25 and the air outlet aperture 26 results in a highly efficient air flow configuration, providing improved suction.

Figure 9:
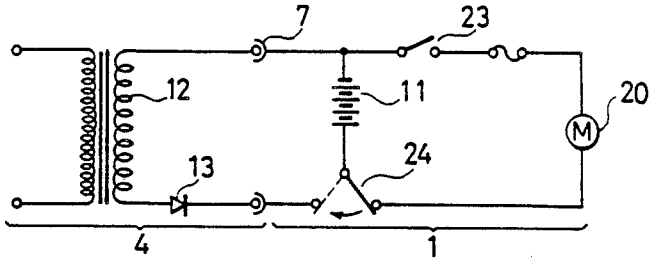
FIG. 9 is a circuit diagram of a charging circuit.

FIG. 9 is a circuit diagram of the present embodiment. For the case indicated by the broken-line representation of microswitch 24, the sliding engagement of one of ribs 6 of charging unit 4 within the groove 2 of vacuum cleaner 1 accommodating microswitch 24 (or an actuating member of microswitch 24) results in microswitch 24 acting to connect one side of rechargeable batteries 11 to rectifier diode 13, while the other side of rechargeable batteries is connected through one of charging terminals 7 to one end of the secondary winding of transformer 12 of charging unit 4. In this condition, assuming that plug 10 is inserted into an AC power outlet, a DC charging voltage produced by rectifier diode 13 and transformer 12 will be applied to rechargeable batteries 11 to implement recharging of the batteries. This will occur irrespective of the condition of press-type switch 23, i.e. in this condition microswitch 24 acts to hold rechargeable batteries 11 effectively disconnected from motor 20. When charging is completed, vacuum cleaner 1 can be removed from charging unit 4, whereupon, as indicated by the full-line representation of microswitch 24, a condition is established in which actuation of the press-type normally-open switch 23 by the user will result in batteries 11 being connected to drive the motor 20.

It will be apparent that when the vacuum cleaner 1 is removed from the charging unit 4, the connecting leads 9 are disconnected from rechargeable batteries 11 by the action of microswitch 24. Thus, any accidental short-circuit across connecting leads 9 due for example to metal objects being inserted into electrical receptacle 8, will not result in rapid discharge of current from rechargeable batteries 11. Such rapid discharging can result in overheating and damage to the batteries.

A rechargeable cordless vacuum cleaner apparatus according to the present invention such as the preferred embodiment described above offers a number of important advangtages. Firstly, due to the shape of the pocket 5 in charging unit 4, with major faces thereof being formed to slope downward towards the front of charging unit 4, the user can easily insert the vacuum cleaner into the charging unit using only one hand. Accurate registration between the charging contacts of the charging unit and the corresponding electrical receptacle of the vacuum cleaner is ensured, when this is done, by the arrangement of mutually slidably engaging ribs and grooves described above. Furthermore, since a vacuum cleaner for such apparatus is preferably formed with an elongated shape, and since the vacuum cleaner can be inserted into and supported in the charging unit in a substantially vertically upright orientation, as in the case of the preferred embodiment, the charging unit can be made very compact in size, and the amount of floor space occupied by the charging unit is minimized.

Furthermore, with the vacuum cleaner inserted in the charging unit, due to the fact that a substantial part of the weight of the vacuum cleaner is acting to urge the charging terminals of the charging unit into the electrical receptacle of the vacuum cleaner, highly reliable electrical contact is maintained between the connecting leads of the vacuum cleaner electrical receptacle and the charging terminals of the charging unit.

In addition, due to the positioning of the nozzle storage mount directly above the portion of the charging unit from which the electric power cord of the charging unit emerges, the danger of accidental damage to the power cord at that position is greatly reduced, leading to greater long-term reliability of operation.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A rechargeable cordless vacuum cleaner apparatus comprising:

a hand-held vacuum cleaner comprising a housing formed with an air inlet at one end thereof, an air outlet at the opposite end thereof, first coupling means located adjacent said opposite end and extending in a direction toward said inlet, said cleaner including, within said housing, rechargeable batteries, a motor adapted to be powered by said batteries, a dust-collection filter located adjacent said opposite end of the housing, a fan driven by said motor to produce an airflow from said inlet to said filter, electrical receptacle means positioned at said opposite end, and connecting leads extending from said electrical receptacle means for connection to said batteries; and a charging unit having a housing formed with a pocket shaped to be detachably engageable with the opposite end portion of said cleaner housing and second coupling means having a shape complementary to said first coupling means to slidably engage with said first coupling means under its own weight when said cleaner is engaged with said pocket to retain said cleaner in an upright position on said charging unit and slidably disengage from said first coupling means when said cleaner is disengaged from said pocket, the charging unit including, within said housing, a rectifier adapted for connection to a main supply and a pair of charging terminals for engaging with said receptacle means and connecting a rectified output of said rectifier to said connecting leads when said cleaner is engaged with said pocket.

2. A rechargeable cordless vacuum cleaner apparatus according to claim 1, in which said vacuum cleaner comprises discharging circuit means connected to said motor and charging circuit means connected to said rectifier, and switch means located on said opposite end of the cleaner housing for connecting said batteries to said discharging circuit means when said cleaner is disengaged from said pocket and connecting said batteries to said charging circuit means when said cleaner is engaged with said pocket.

3. A rechargeable cordless vacuum cleaner apparatus according to claim 1, in which said charging terminals are located in said pocket.

4. A rechargeable cordless vacuum cleaner apparatus according to claim 3, in which said second coupling means is located in said pocket.

5. A rechargeable cordless vacuum cleaner apparatus according to claim 1, in which said cleaner further includes a nozzle detachably engageable with said inlet, and said charging unit further comprises a nozzle storage mount for removably storing said nozzle.

6. A rechargeable cordless vacuum cleaner apparatus according to claim 5, in which said charging unit further comprises a cord outlet located below said nozzle storage mount and an electric power cord retractable into the inside of the charging unit housing through said cord outlet.

7. A rechargeable cordless vacuum cleaner apparatus according to claim 6, and further comprising an interchangeable pair of said nozzles comprising a long nozzle and a short nozzle, and wherein said nozzle storage mount includes a first stopper member for determining a depth of insertion of said short nozzle in said nozzle mount, and a second stopper member for determining a depth of insertion of said long nozzle in said nozzle mount, with said second stopper member being positioned such as to permit insertion of said long nozzle into said nozzle mount to a greater depth than said shorter nozzle.

8. A rechargeable cordless vacuum cleaner apparatus comprising:

a hand-held cordless vacuum cleaner having rechargeable batteries, a fan, a motor for driving said fan, and a dust collection filter disposed internally therein and having a nozzle mounted at one end thereof, and having grooves formed on mutually opposite sides of a lower end thereof and electrical receptacle means disposed at said end with connecting leads extending into said electrical receptacle means; and a charging unit having a transformer and a rectifier diode mounted internally therein, and having a pocket formed therein for removably retaining said hand-held cordless vacuum cleaner, shaped in accordance with said lower end of said hand-held cordless vacuum cleaner such that with said lower end of said hand-held cordless vacuum cleaner inserted into said pocket said hand-held cordless vacuum cleaner is maintained by the weight thereof within said pocket, said charging unit further including at least two ribs formed within said pocket, positioned to slidably engage with said grooves of said hand-held cordless vacuum cleaner when said hand-held cordless vacuum cleaner is inserted in said pocket, and moreover including a pair of charging terminals spaced apart substantially mutually parallel and protruding substantially vertically upward with said ribs disposed closely adjacent thereto, said charging terminals being positioned to engage within said electrical receptacle means and establish electrical contact with said connecting leads when said hand-held cordless vacuum cleaner is inserted in said pocket, with said electrical contact being maintained by the weight of said hand-held cordless vacuum cleaner acting to urge said charging terminals into said electrical receptacle means;

said hand-held cordless vacuum cleaner further comprising discharge circuit means for connecting said rechargeable batteries to said motor and charging circuit means for connecting said rechargeable batteries to said connecting leads of said electrical receptacle means, and microswitch means for selectively connecting said rechargeable batteries to said discharge circuit means and said charging circuit means, said microswitch means having at least a portion thereof disposed within one of said grooves of said hand-held cordless vacuum cleaner and being adapted to disconnect said rechargeable batteries from said discharge circuit means and connect said rechargeable batteries to said charging circuit means when said hand-held cordless vacuum cleaner is inserted into said pocket of said charging unit.

* * * * *